US008701756B2

(12) United States Patent
Nguyen et al.

(10) Patent No.: US 8,701,756 B2
(45) Date of Patent: Apr. 22, 2014

(54) INTERNAL LOCKDOWN SNUBBING PLUG

(75) Inventors: Dennis P. Nguyen, Pearland, TX (US); Stephen C. Muse, Magnolia, TX (US)

(73) Assignee: Cameron International Corporation, Houston, TX (US)

( * ) Notice: Subject to any disclaimer, the term of this patent is extended or adjusted under 35 U.S.C. 154(b) by 313 days.

(21) Appl. No.: 12/920,823

(22) PCT Filed: Feb. 25, 2009

(86) PCT No.: PCT/US2009/035166

§ 371 (c)(1),
(2), (4) Date: Sep. 2, 2010

(87) PCT Pub. No.: WO2009/120446

PCT Pub. Date: Oct. 1, 2009

(65) Prior Publication Data

US 2011/0011598 A1 Jan. 20, 2011

Related U.S. Application Data

(60) Provisional application No. 61/039,391, filed on Mar. 25, 2008.

(51) Int. Cl.
*E21B 33/12* (2006.01)

(52) U.S. Cl.
USPC ..... 166/192; 166/386; 166/150; 166/183

(58) Field of Classification Search
USPC ..... 166/386, 192, 142, 147, 149, 150, 183, 166/188, 69
See application file for complete search history.

(56) References Cited

U.S. PATENT DOCUMENTS

| | | | |
|---|---|---|---|
| 1,842,270 | A | 1/1932 | Johnston |
| 2,170,057 | A | 8/1939 | Kerr |
| 2,397,472 | A | 4/1946 | Crowell |
| 2,919,709 | A | 1/1960 | Schwegman |
| 2,935,132 | A | 5/1960 | Arterbury et al. |
| 3,065,796 | A | 11/1962 | Nutter |
| 3,105,553 | A | 10/1963 | Chisholm |

(Continued)

FOREIGN PATENT DOCUMENTS

| | | |
|---|---|---|
| EP | 1233145 | 8/2002 |
| GB | 2287267 | 9/1995 |
| GB | 2312455 | 10/1997 |
| WO | WO0183938 | 11/2001 |

OTHER PUBLICATIONS

International Search Report and Written Opinion of PCT/US2009/035166 dated Sep. 22, 2009.

(Continued)

*Primary Examiner* — David Bagnell
*Assistant Examiner* — Taras P Bemko
(74) *Attorney, Agent, or Firm* — Fletcher Yoder, P.C.

(57) ABSTRACT

A snubbing plug is configured to be secured within a component of a mineral extraction system by an internal locking mechanism. In addition, the snubbing plug enables pressure equalization of regions above and below the plug before removal of the plug. Upon insertion of the snubbing plug into a well component, pressure may be equalized via fluid pathways through the snubbing plug. The pathways are sealed closed during snubbing operations and opened again when snubbing operations are complete. Manipulation of the fluid pathways may be accomplished via rotation of a load ring within the snubbing plug.

19 Claims, 7 Drawing Sheets

(56) References Cited

U.S. PATENT DOCUMENTS

| | | | | |
|---|---|---|---|---|
| 3,141,506 | A | 7/1964 | Thomas | |
| 3,249,124 | A | 5/1966 | Berryman | |
| 3,250,331 | A | 5/1966 | Boyle | |
| 3,581,819 | A | 6/1971 | Tamplen | |
| 3,610,337 | A | 10/1971 | Lewis | |
| 3,662,826 | A | 5/1972 | Young et al. | |
| 3,897,824 | A | 8/1975 | Fisher | |
| 3,954,138 | A | 5/1976 | Miffre | |
| 3,965,978 | A | 6/1976 | Conley et al. | |
| 3,987,848 | A | 10/1976 | Canterbury | |
| 4,058,162 | A | 11/1977 | Smith | |
| 4,121,660 | A | 10/1978 | Koleilat | |
| 4,260,020 | A | 4/1981 | Nelson et al. | |
| 4,825,945 | A | 5/1989 | Smith | |
| 5,398,764 | A | 3/1995 | Collins | |
| 5,509,476 | A * | 4/1996 | Vick, Jr. | 166/75.13 |
| 6,095,249 | A | 8/2000 | McGarian et al. | |
| 6,427,773 | B1 | 8/2002 | Albers | |
| 6,889,771 | B1 * | 5/2005 | Leising et al. | 166/373 |
| 7,527,104 | B2 | 5/2009 | Branch et al. | |
| 2007/0204986 | A1 * | 9/2007 | Sorhus | 166/192 |
| 2011/0011598 | A1 | 1/2011 | Nguyen et al. | |

OTHER PUBLICATIONS

PCT International Search Report and Written Opinion for PCT/US2008/087046, dated Jul. 27, 2009.

* cited by examiner

INTERNAL LOCKDOWN SNUBBING PLUG

CROSS-REFERENCE TO RELATED APPLICATIONS

This application claims priority to PCT Application No. PCT/US2009/035166 entitled "Internal Lockdown Snubbing Plug", filed on Feb. 25, 2009, which is herein incorporated by reference in its entirety, and which claims priority to U.S. Provisional Patent Application No. 61/039,391, entitled "Internal Lockdown Snubbing Plug", filed on Mar. 25, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and the like, that facilitate drilling and/or extraction operations.

In some instances, well intervention, or any work involving maintenance, modification, repair, or completion of the well, may be performed by first killing the well and then removing pressure control equipment to enable pipes and/or tools to be lowered into the well. Well kill involves adding heavy fluid to a wellbore to provide hydrostatic pressure, thereby preventing the flow of reservoir fluids from the well. The heavy fluid provides enough pressure to overcome the pressure of the reservoir fluids such that pressure control equipment may be removed from the wellhead assembly to enable completion of the desired intervention. The heavy fluid introduced into the wellbore may impair the resumption of fluid flow after completion of the well intervention. Accordingly, in order to resume production after killing the well, the added heavy fluid is removed from the wellbore.

As an alternative to killing the well to enable intervention work, a technique known as snubbing may be employed while the well is under pressure. In snubbing, a plug is inserted into the well, for example, in the tubing spool. Pressure is thereby isolated upstream of the plug (e.g., between the plug and a mineral deposit, or below the plug), and repairs or modifications may be made to well components downstream of the plug (e.g., between the plug and a riser, or above the plug). When the well intervention is complete, the snubbing plug may be removed and well operations may proceed as usual.

BRIEF DESCRIPTION OF THE DRAWINGS

Various features, aspects, and advantages of the present invention will become better understood when the following detailed description is read with reference to the accompanying figure, wherein.

DETAILED DESCRIPTION OF SPECIFIC EMBODIMENTS

Figure 1:
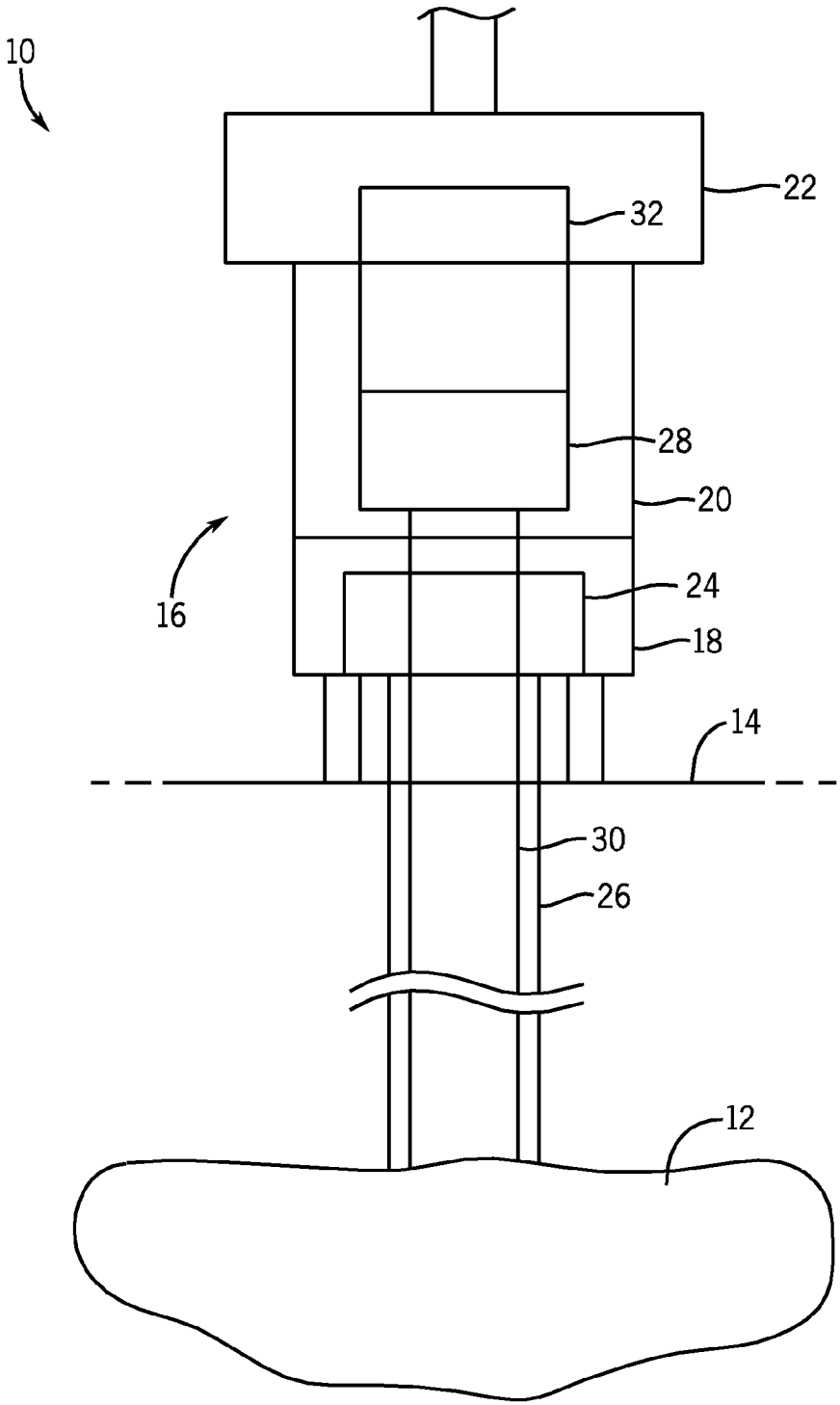
FIG. 1 is a block diagram of a mineral extraction system in accordance with embodiments of the present invention.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

As discussed further below, snubbing operations may be conducted while the well is under pressure. A securing device holds the snubbing plug in place during the course of well intervention. One or more external fasteners, such as tie-down pins, may be used as the securing device for holding the snubbing plug within the wellhead component. The tie-down pins function by protruding radially through the walls of the wellhead component and holding the snubbing plug in place (i.e., preventing the snubbing plug from axial movement with respect to the wellhead component). Upon advancement of the tie-down pins into the wellhead component, a compression seal disposed between the snubbing plug and the wellhead component is compressed such that pressure may not be transferred between the snubbing plug and the wellhead component. Unfortunately, because the tie-down pins protrude through the walls of the wellhead component, they must be secured via an external force. For example, the tie-down pins may be large screws which are advanced into the wellhead via rotational movement applied to a portion of the tie-down pins which protrudes from the exterior of the wellhead. This rotational force operates to advance the tie-down pins in a generally radial direction into the wellhead component (e.g., transverse to an axis of the wellhead component), and must be applied at the location of the snubbing plug. That is, wherever the snubbing plug is disposed within the wellhead component, tie-down pins protruding from the wellhead at that location must be screwed in to secure the snubbing plug in place within the wellhead component.

In contrast, in embodiments described below, the securing device includes an internal lockdown mechanism (e.g., an inner locking ring, a threading, etc.). By securing the snubbing plug to the wellhead component internally (i.e., via a mechanism disposed entirely within the wellhead component), the need for an external fastener is eliminated, and installation of the snubbing plug is greatly simplified. In certain embodiments, the disclosed snubbing plug may include a mount consisting essentially of an internal lockdown mechanism (i.e., a lockdown mechanism internal to the wellhead component in which the snubbing plug is installed). The disclosed snubbing plug may also be described as excluding external mounts in certain embodiments. That is, there may be no fasteners or other securing mechanisms external to the wellhead component which mount the snubbing plug within the component. Moreover, this lack of external penetrations reduces the potential for leakage or integrity-related failure.

In addition, one or more fluid pathways through the snubbing plug enable pressure to be equalized above and below the plug during insertion of the plug within the wellhead. After the well intervention is complete, the snubbing plug may be removed. However, due to the difference in pressure above and below the plug, the plug and its associated tool and rod may be rapidly ejected upon release of the snubbing plug. Accordingly, in embodiments discussed below, a pressure equilibration mechanism may be incorporated into the snubbing plug to equalize pressure above and below the plug before the plug is unsecured from the wellhead. By providing a fluid path through the snubbing plug, the pressure equilibration mechanism may equalize pressure above and below the snubbing plug before the snubbing plug is removed from the wellhead.

FIG. 1 illustrates a mineral extraction system 10 equipped for snubbing operations in accordance with exemplary embodiments of the present technique. The mineral extraction system 10 may be configured to extract minerals, such as oil and gas, from a mineral deposit 12 beneath a surface 14. In various embodiments, the mineral deposit 12 may be located under the sea floor or under dry land.

The illustrated mineral extraction system 10 includes a wellhead 16 having a casing spool 18, a tubing spool 20, and a blowout preventer 22. The casing spool 18 houses a casing hanger 24 that supports a casing 26. Similarly, the tubing spool 20 has a tubing hanger 28 that supports a production tubing 30. Multiple tubings may be disposed concentrically within the casing 26. The production tubing 30 may be utilized to transfer minerals from the mineral deposit 12 to the wellhead 16. Other tubings and/or the casing 26 may be utilized to transport various production fluids to and from the mineral deposit 12 or to isolate various regions of the formation, for instance.

In order to enable well intervention without killing the well, a snubbing plug 32 may be disposed above the tubing hanger 28. The snubbing plug 32 may substantially seal the wellhead 16 during snubbing operations, while equilibrating pressure above and below the snubbing plug 32 before the plug 32 is removed from the wellhead 16. In the illustrated embodiment, the snubbing plug 32 is disposed below the blowout preventer 22 such that any unexpected pressure release from the well may be contained by the blowout preventer 22 so that minerals are not released into the environment. Additional valves and blowout preventers 22 also may be installed above the snubbing plug 32. Thus, one or more blowout preventers 22 may be opened to enable running in and removal of the snubbing plug 32.

Figure 2:
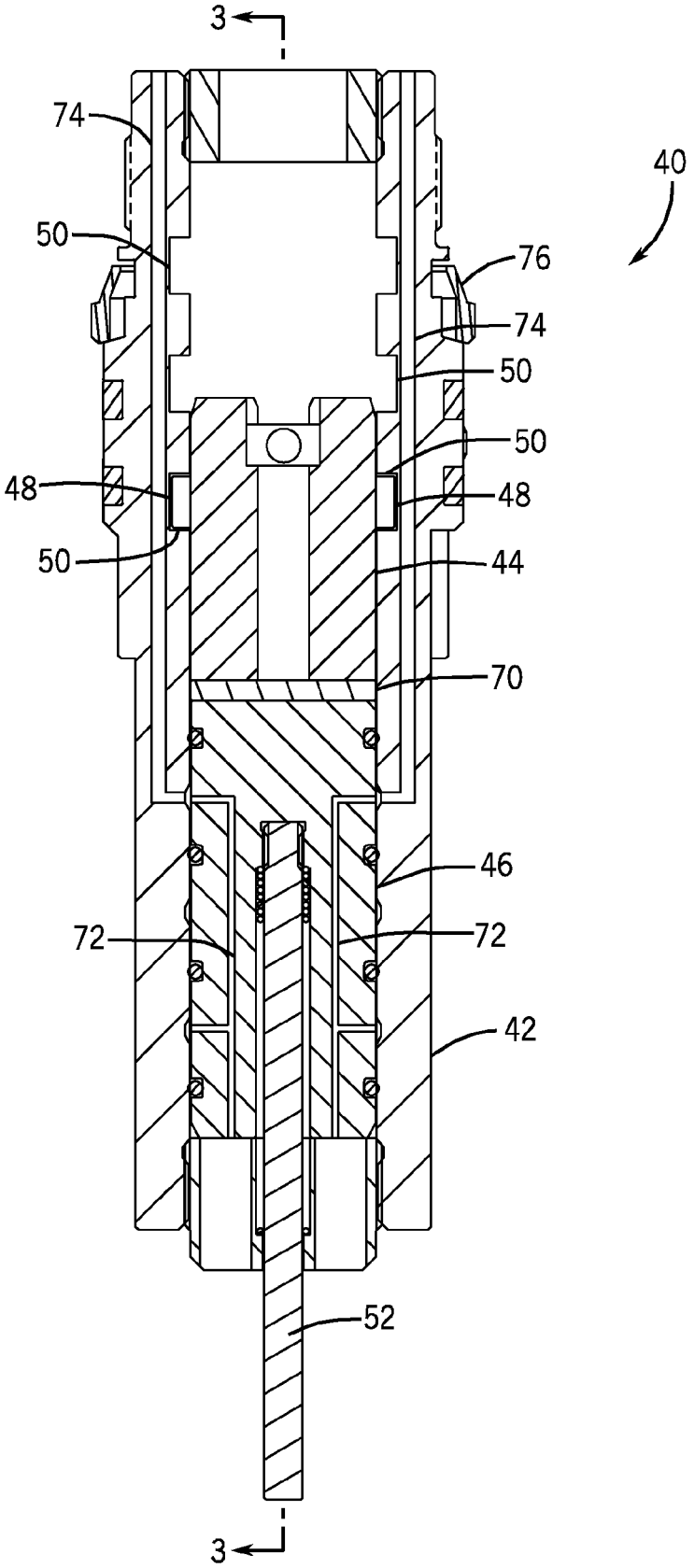
FIG. 2 is a partial cross-section of an exemplary snubbing plug that may be used in the mineral extraction system illustrated in FIG. 1.
Figure 3:
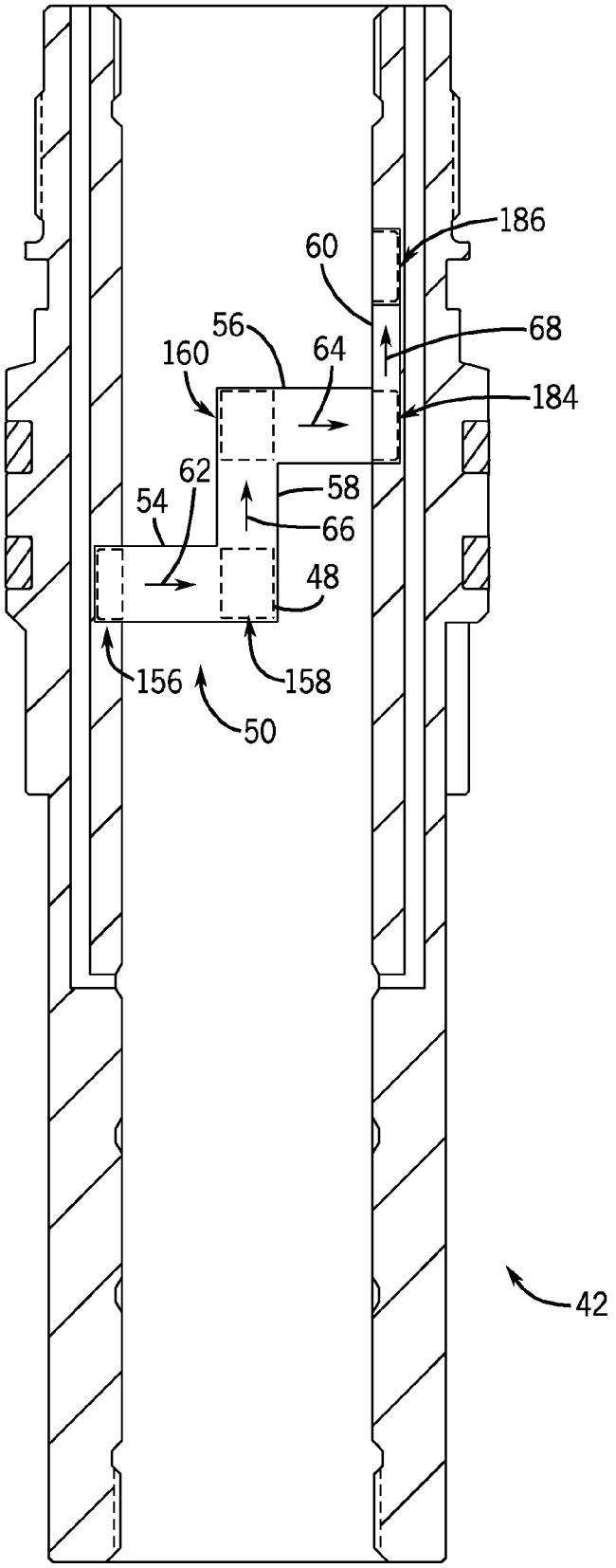
FIG. 3 is a partial cross-section of a component of the snubbing plug illustrated in FIG. 2.

FIG. 2 is a partial cross-section of an exemplary snubbing plug 40 for use in the mineral extraction system illustrated in FIG. 1. The snubbing plug 40 generally includes a body 42, a load ring 44, and a piston 46. Protruding from the load ring 44 are one or more load pins 48 which correspond to one or more slots 50 in the body 42. The load ring 44 may rotate around and move along an axis 52 with respect to the body 42. Movement of the load ring 44 is limited by engagement of the slots 50 with the load pins 48. FIG. 3 illustrates an exemplary configuration of the slot 50 in a cross-section of the body 42 through a line 3-3 (FIG. 2). As illustrated in FIG. 3, the slot 50 may contain a plurality of circumferential paths 54 and 56 (e.g., paths that limit the pin 48 to movement about an inner circumference of the body 42) and a plurality of axial paths 58 and 60 (e.g., paths that limit the pin 48 to movement along the axis 52). Accordingly, the load ring 44 may only rotate to the degree that the load pins 48 may travel circumferentially along the paths 54 and 56 (i.e., along arrows 62 and 64). Likewise, the load ring 44 may only move axially to the extent that the load pins 48 may move axially within the paths 58 and 60 (i.e., along arrows 66 and 68).

Referring again to FIG. 2, the piston 46 may also move along the axis 52 in conjunction with the load ring 44. A bearing 70 between the load ring 44 and the piston 46 enables rotation of the load ring 44 with respect to the piston 46. This configuration enables fluid pathways through the snubbing plug 40 to be opened and closed by simply rotating the load ring 44. That is, one or more bores 72 in the piston 46 may align with one or more bores 74 in the body 42 depending on the axial position of the piston 46, thereby opening and/or closing fluid pathways through the snubbing plug 40. The load ring 44, the piston 46, the load pins 48, and the bearing 70 may be considered components of a valve which can be opened or closed to equalize or isolate fluid pressure, respectively. In addition, the snubbing plug 40 may include a locking ring 76 to enable secure attachment of the plug 40 within the wellhead without external fasteners, as described in more detail below.

Figure 4:
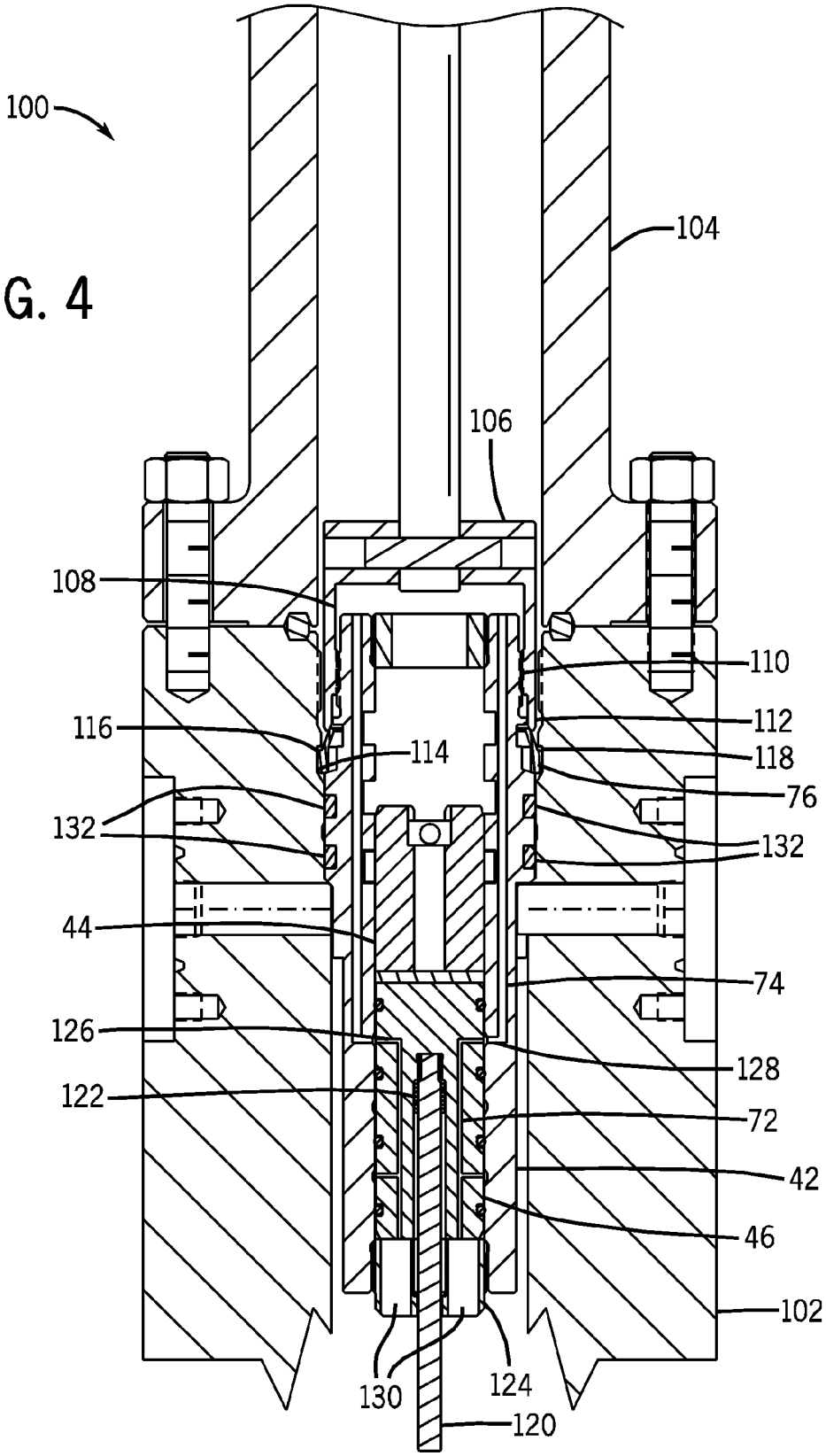
FIG. 4 is a partial cross-section of the exemplary snubbing plug illustrated in FIG. 2 in a pressure equalization running position.

Turning to FIG. 4, the exemplary snubbing plug 40 is illustrated in a pressure equalization running position 100 as it is landed in an exemplary tubing spool 102. However, the snubbing plug 40 may be utilized to provide a pressure seal in any wellhead component. In the illustrated embodiment, a blowout preventer 104 is disposed above and secured to the tubing spool 102 during snubbing operations. Any wellhead component may be situated above the snubbing plug 40 while it is installed in a wellhead component (e.g., the tubing spool 102). Moreover, the snubbing plug 40 can be employed to close a variety of annular regions, including the production casing, for example, A running tool 106 may be secured to the snubbing plug 40, for example, via complimentary threads 108 and 110 on the running tool 106 and the snubbing plug 40, respectively. The running tool 106 may include a lip 112 which compresses the locking ring 76 while the running tool 106 advances the snubbing plug 40 into the tubing spool 102. Upon detachment or retraction of the running tool 106, the locking ring 76 may automatically expand radially into a locking recess 114 in the tubing spool 102. Complimentary shoulders 116 and 118 on the locking ring 76 and the locking recess 114, respectively, prevent the snubbing plug 40 from moving axially upward with respect to the tubing spool 102. That is, the shoulder 116 on the locking ring 76 may be pressed against the shoulder 118 on the locking recess 114, thereby blocking axial movement of the snubbing plug 40 with respect to the tubing spool 102. This internal locking mechanism enables installation of the snubbing plug 40 without external fasteners. That is, external fasteners are not advanced through an outer wall of the tubing spool 102 to secure the snubbing plug 40 within the tubing spool 102. The internal locking function, whether lock ring, threads, segment, or dogs, enables faster and easier installation of the snubbing plug 40, thereby reducing the costs associated with snubbing operations.

Turning back to FIG. 4, a shaft 120 provides a running guide for installation of the snubbing plug 40. In addition, a spring 122 may be disposed about the shaft 120 to apply axial load to the piston 46. That is, the spring 122 may be secured within the snubbing plug 40 by a hold down ring 124 and held in place by the shaft 120. The spring 122 provides a force which automatically biases the piston 46 away from the hold down ring 124 and towards the bearing 70, thereby enabling positioning of the piston 46 via adjustment of the load ring 44 when the wellbore has low or no pressure.

During advancement of the snubbing plug 40 into the tubing spool 102, pressure below the plug 40 may be released through the snubbing plug 40 via the bores 72 in the piston 46 and the bores 74 in the body 42. That is, a first opening 126 in the bore 72 is aligned with an opening 128 in the bore 74. One or more bores 130 in the hold down ring 124 enable flow of fluid pressure into the bores 72 in the piston 46. One or more radial seals 132 disposed about the body 42 may disable fluid from flowing between the snubbing plug 40 and the tubing spool 102 during installation of the plug 40.

Figure 5:
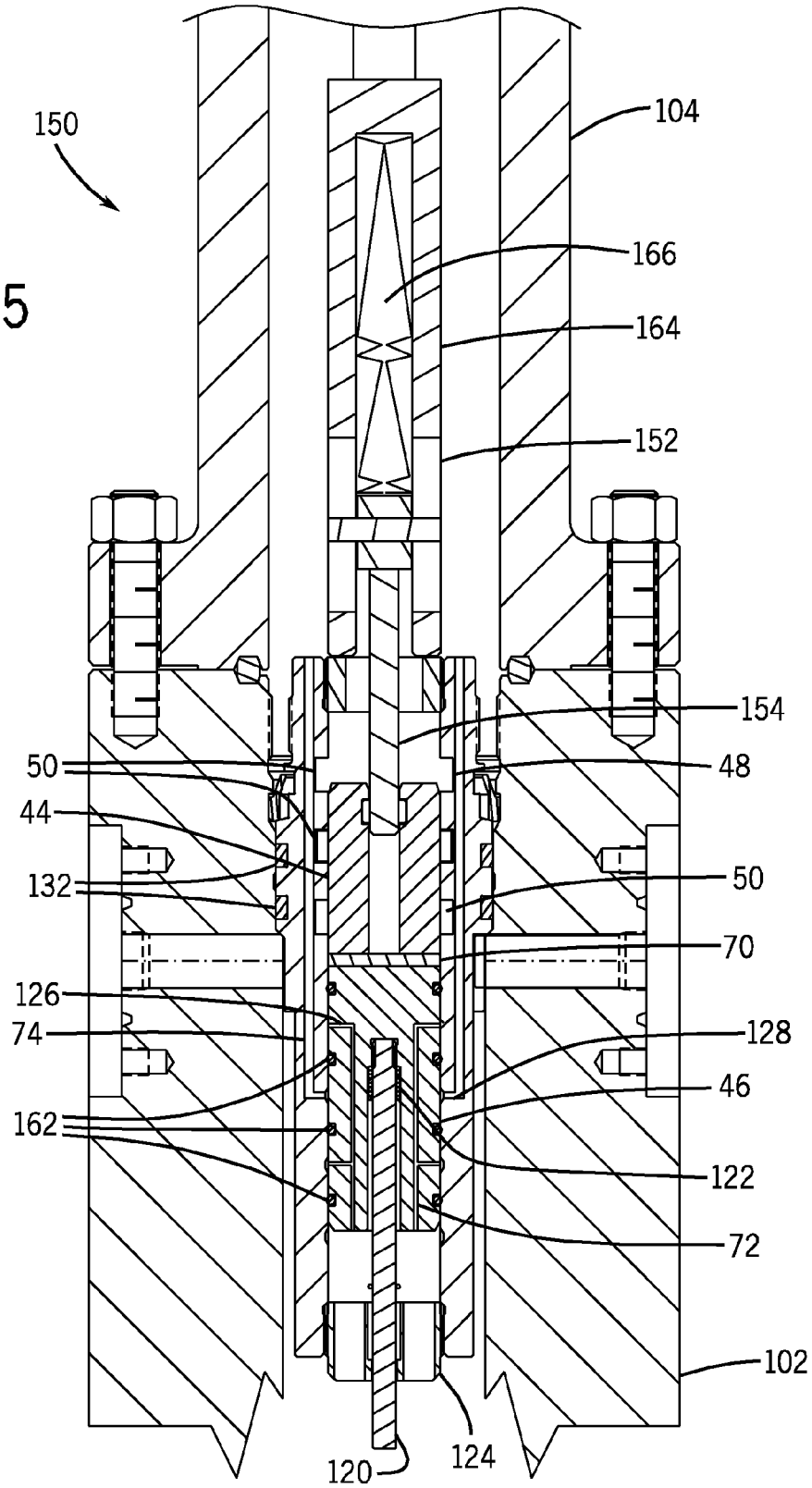
FIG. 5 is a partial cross-section of the exemplary snubbing plug illustrated in FIG. 2 in a pressure isolation position.

After installation of the snubbing plug 40 in the tubing spool 102, the plug 40 may be moved into a pressure isolation position 150, as illustrated in FIG. 5. This conversion may be facilitated by a pressure tool 152. The pressure tool 152 and the running tool 106 (FIG. 3) may be one tool which performs multiple functions, or separate tools may be utilized for the various snubbing operations. In either embodiment, the lip 112 (FIG. 4) is axially retracted to enable the snubbing plug 40 to lock in place within the tubing spool 102.

The pressure tool 152 may be connected to the load ring 44 via a shaft 154 such that rotation of the shaft 154 rotates the load ring 44 with respect to the body 42. Referring again to FIG. 3, upon rotation of the load ring 44, the load pin 48 moves from a first position 156 along the circumferential pathway 54 to a second position 158 (e.g., in the direction of the arrow 62). Due to upward force on the piston 46 (e.g., from fluid pressure below the snubbing plug 40 and/or applied force from the spring 122), the piston 46, the bearing 70, and the load ring 40 automatically move axially upward upon reaching the second position 158. The load pin 48 moves from the second position 158 to a third position 160 along the axial pathway 58 (e.g., in the direction of the arrow 66).

Turning back to FIG. 5, it can be seen that the fluid pathways through the snubbing plug 40 have been closed. That is, bores 72 are isolated from bores 74, and a plurality of elastomer seals 162 disposed between the piston 46 and the body 42 isolate the first opening 126 and the opening 128. The elastomer seals 162 further disable fluid pressure from escaping between the piston 46 and the body 42. As described above, the radial seals 132 block pressure transfer between the body 42 and the tubing spool 102. Accordingly, any pressure trapped below the snubbing plug 40 is isolated while the plug 40 is in the pressure isolation position 150. Snubbing operations may therefore be carried out while the well is sealed.

In certain embodiments, a mechanism 164 incorporated into the pressure tool 152 may prevent axial displacement of the tool 152 with respect to the snubbing plug 40 when the load ring 42 and the piston 46 are moved. That is, movement of the load ring 44 and the shaft 154 coupled thereto, due to pressure kickback from the well, may be absorbed by compression of a spring 166 within the pressure tool 152. This movement absorption mechanism 164 blocks axial movement within the snubbing plug 40 from being conveyed to the surface where users may be in proximity to the pressure tool 152.

Figure 6:
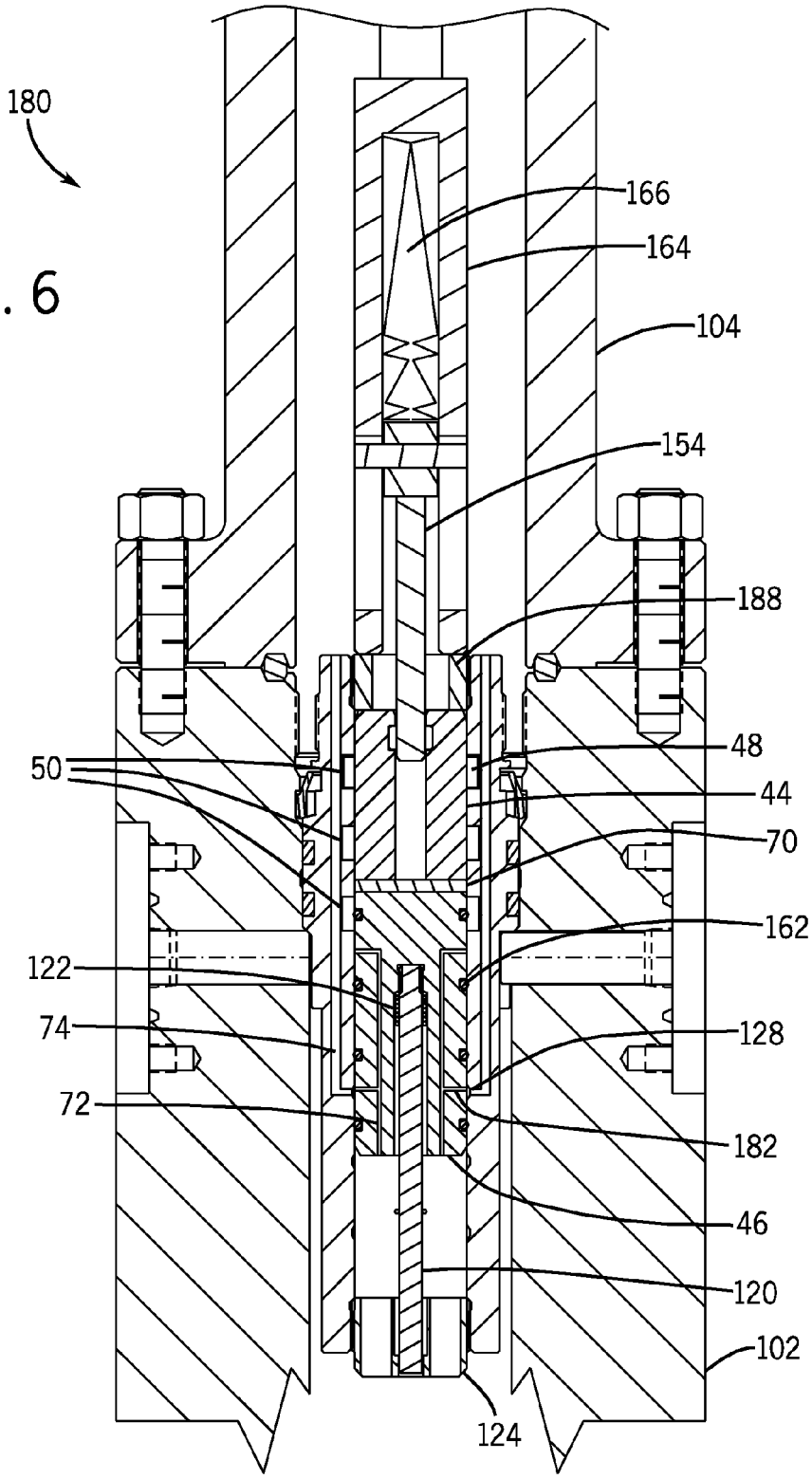
FIG. 6 is a partial cross-section of the exemplary snubbing plug illustrated in FIG. 2 in a pressure equalization retrieval position.

After the snubbing operations have been completed, the snubbing plug 40 may be removed so that normal well operations may resume. Before the plug 40 is removed, it may be desirable to equalize pressure above and below the plug 40. This pressure equalization step may prevent the snubbing plug 40 from possibly being ejected when the plug 40 is no longer secured to the tubing spool 102. FIG. 6 illustrates the plug 40 in an exemplary pressure equalization retrieval position 180. As seen in FIG. 6, the bores 72 and 74 are again in fluid communication with each other. That is, a second opening 182 in the bore 72 is aligned with the opening 128 in the bore 74. This configuration enables fluid pressure to be conveyed through the snubbing plug 40 before the plug 40 is removed from the tubing spool 102.

The piston 46 is moved into the pressure equalization retrieval position 180 by another rotation of the load ring 44. As illustrated in FIG. 3, further rotation of the load ring 44 moves the load pin 48 from the third position 160 to a fourth position 184 along the circumferential path 56 (e.g., in the direction of the arrow 64). Again, once the pin 48 reaches the fourth position 184, an upward force on the piston 46 (e.g., from fluid pressure below the snubbing plug 40 and/or applied force from the spring 122) biases the load ring 44 axially upward. The load pin 48 is automatically moved from the fourth position 184 to a fifth position 186 along the axial pathway 60 (e.g., in the direction of the arrow 68). The pin 48 in the slot 50 blocks the load ring 44 from further axial movement. In addition, returning to FIG. 6, it can be seen that the load ring 44 and the piston 46 are prevented from further axial movement by a hold down ring 188.

After pressure equalization, the running tool 106 (FIG. 4) may again be secured to the snubbing plug 40. Advancement of the lip 112 compresses the locking ring 76 such that the shoulder 116 on the locking ring 76 may be moved past the shoulder 118 on the locking recess 114, thereby enabling removal of the snubbing plug 40 from the tubing spool 102.

Figure 7:
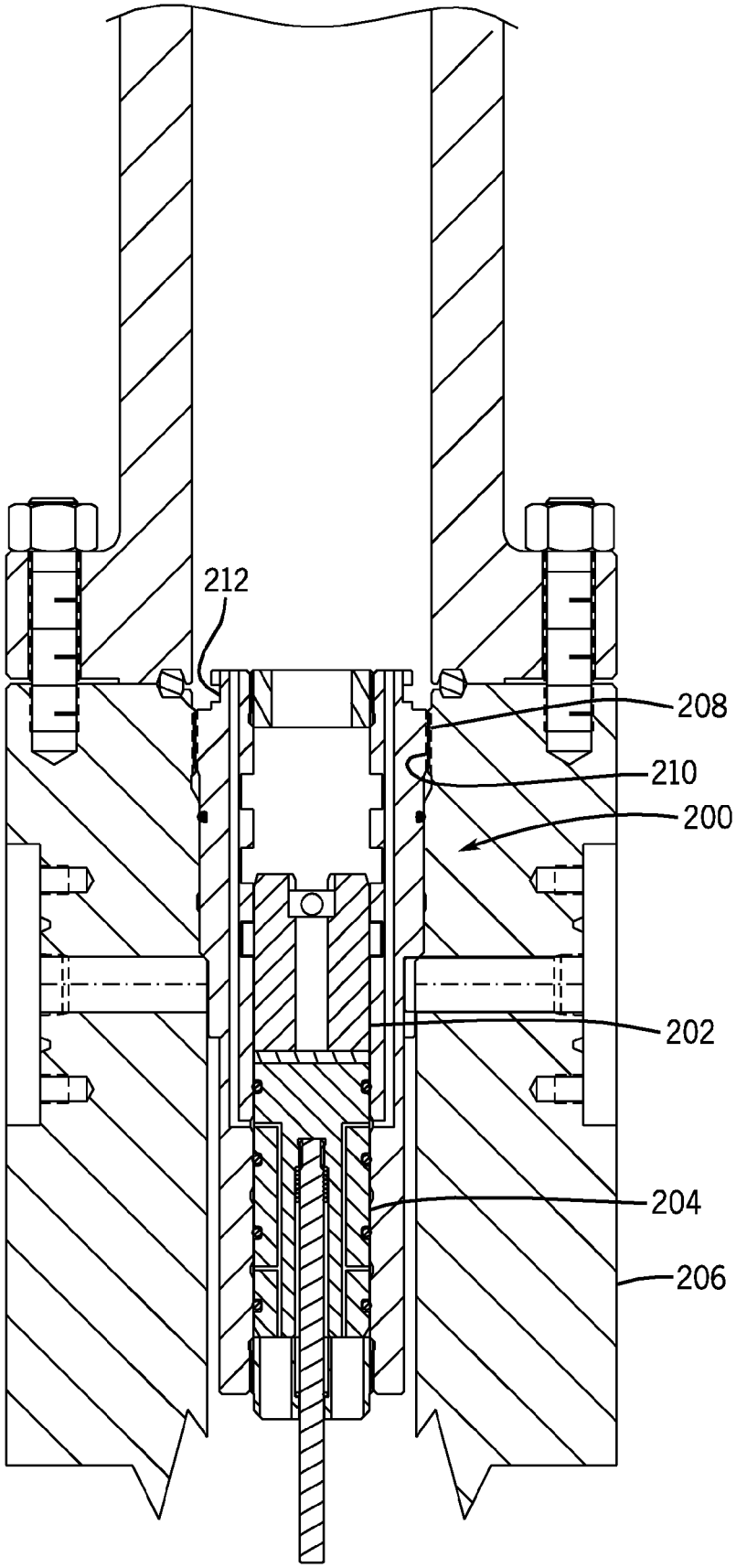
FIG. 7 is a partial cross-section of another exemplary snubbing plug that may be used in the mineral extraction system illustrated in FIG. 1.

Another embodiment of a snubbing plug 200 is illustrated in FIG. 7. A load ring 202 and a piston 204 in the snubbing plug 200 operate similarly to those in the snubbing plug 40 to open and/or close fluid pathways through the plug 200. The snubbing plug 200 is illustrated secured to a tubing spool 206. However, the plug 200 may be installed in other mineral extraction equipment. In the embodiment illustrated in FIG. 7, complimentary threading 208 and 210 on the snubbing plug 200 and the tubing spool 206, respectively, enable secure attachment of the plug 200 to the spool 206. The snubbing plug 200 may be run into and secured to the tubing spool 206 via a running tool (not shown) coupled to the plug 200 by a "J" slot 212. That is, a connector on the running tool may correspond to the "J" slot 212 such that pressure and/or rotation of the tool engages and/or disengages the tool from the plug 200. In this embodiment, the snubbing plug 200 may be secured within the tubing spool 206 via rotation of the snubbing plug 200 with respect to the tubing spool 206, thereby engaging and securing the threads 208 and 210. While a rotational force may be applied to the snubbing plug 200 to implement the internal lockdown mechanism, this force may be applied from the running tool. This technique is therefore easier to implement than the presently-utilized tie-down pins which are generally employed to secure the snubbing plug within the tubing spool. As described with respect to the first embodiment illustrated in FIGS. 2-6, manipulation of the load ring 202 in the present embodiment may be accomplished via a pressure tool (not shown).

In view of the embodiments discussed above, the snubbing plug having an internal lockdown mechanism may be easily installed in a wellhead component below the ground surface or subsea. That is, because no external force is applied at the snubbing plug (i.e., tie-down pins are not advanced into the wellhead component to secure the snubbing plug in place), the plug may be installed entirely via the running tool. A one-trip installation may therefore be implemented which greatly reduces the time and cost of snubbing.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a plug, comprising:

one or more fluid pathways extending between upstream and downstream sides of the plug;

a valve configured to open and close the one or more fluid pathways;

an internal lockdown mechanism positionable in an unlocked position and a locked position, wherein the internal lockdown mechanism is resiliently biased to the locked position upon release from the unlocked position, wherein the locked position is configured to internally secure the plug within a wellhead component.

2. The system of claim 1, wherein the internal lockdown mechanism comprises a locking ring.

3. The system of claim 2, wherein the locking ring is configured to automatically expand outward in a radial direction in response to retraction of a running tool.

4. The system of claim 1, wherein the unlocked position has the internal lockdown mechanism held in compression by a catch, and the catch is configured to release the internal lockdown mechanism to enable the internal lockdown mechanism to automatically expand from the unlocked position to the locked position.

5. The system of claim 4, wherein the catch is controlled by a running tool.

6. The system of claim 1, wherein the fluid pathways comprise one or more first bores through a body of the plug and one or more second bores through a piston disposed within the body, and the fluid pathways are open when the first bores are in fluid communication with the second bores.

7. The system of claim 6, wherein the valve comprises a load ring configured to limit axial movement of the valve relative to the plug and the piston, and the valve is configured to open and close the fluid pathways via axial movement of the piston with respect to the body.

8. The system of claim 1, wherein the plug is a snubbing plug.

9. A system, comprising:

a plug comprising:

a securing mechanism positionable in an unlocked position and a locked position on an exterior of a body of the plug, wherein the securing mechanism is resiliently biased to the locked position upon release from the unlocked position, and the securing mechanism is configured to secure the plug inside a mineral extraction component without fasteners external to the mineral extraction component; and a valve disposed within the body and configured to open and close fluid pathways extending between upstream and downstream sides of the plug, wherein the valve is configured to move along a sequence of movement paths that alternate between only rotational and only axial directions of movement.

10. The system of claim 9, wherein the valve comprises:

a piston disposed within a central bore of the body and configured to open and close the fluid pathways via axial movement relative to a longitudinal axis of the body; and a load ring disposed within the central bore, wherein the load ring comprises a valve mechanism configured to limit axial movement of the piston relative to the longitudinal axis of the body.

11. The system of claim 10, wherein the valve mechanism comprises a load pin extending radially into a slot disposed in the central bore, wherein the slot has a radial depth and a path transverse to the radial depth, and the load pin is movable along the path to impart axial movement to the piston to open and close the fluid pathways.

12. The system of claim 11, wherein the path comprises a plurality of circumferential portions relative to a circumference of the central bore and a plurality of axial portions relative to the longitudinal axis of the body.

13. The system of claim 9, wherein the plug is a snubbing plug.

14. A method, comprising:

inserting a plug into a component of a mineral extraction system, wherein the plug comprises at least one fluid pathway extending from an upstream side to a downstream side of the plug, and the at least one fluid pathway is open during insertion of the plug; and locking the plug in place within the component via an internal locking mechanism, wherein the internal locking mechanism is configured to move between an unlocked position and a locked position; and opening and closing a fluid pathway with a valve in a sequence of movement paths that alternate between only rotational and only axial directions of movement.

15. The method of claim 14, wherein closing the at least one fluid pathway isolates pressure upstream of the plug, and opening the at least one fluid pathway equalizes pressure upstream and downstream of the plug before removing the plug from the component.

16. The method of claim 14, wherein opening and closing the valve comprises rotating a tool coupled to the valve.

17. The method of claim 14, wherein opening and closing the valve comprises rotating and axially moving the valve relative to the body.

18. The method of claim 14, wherein locking the plug in place comprises releasing a locking device of the internal locking mechanism to enable automatic expansion of the locking device in a radial outward direction from the unlocked position to the locked position into a locking recess in the component, wherein enabling expansion of the locking device comprises retracting a running tool configured to compress the locking device while coupled to the plug.

19. The system of claim 14, wherein the plug is a snubbing plug.

* * * * *